US008952627B2

(12) United States Patent
Tomiyama et al.

(10) Patent No.: US 8,952,627 B2
(45) Date of Patent: Feb. 10, 2015

(54) ILLUMINATING DEVICE AND ILLUMINATING METHOD

(75) Inventors: Sayaka Tomiyama, Kanagawa-ken (JP); Masahiko Kamata, Kanagawa-ken (JP); Toshihiko Sasai, Kanagawa-ken (JP); Hitoshi Kawano, Kanagawa-ken (JP); Naoko Iwai, Kanagawa-ken (JP); Masatoshi Kumagai, Kanagawa-ken (JP); Toru Ishikita, Kanagawa-ken (JP); Hiromichi Nakajima, Kanagawa-ken (JP)

(73) Assignee: Toshiba Lighting & Technology Corporation, Kanagawa (JP)

( * ) Notice: Subject to any disclaimer, the term of this patent is extended or adjusted under 35 U.S.C. 154(b) by 139 days.

(21) Appl. No.: 13/331,839

(22) Filed: Dec. 20, 2011

(65) Prior Publication Data

US 2012/0153841 A1 Jun. 21, 2012

(30) Foreign Application Priority Data

Dec. 21, 2010 (JP) ..... 2010-284905

(51) Int. Cl.
*G05F 1/00* (2006.01)
*H05B 33/08* (2006.01)

(52) U.S. Cl.
CPC ..... *H05B 33/0869* (2013.01)
USPC ..... 315/291

(58) Field of Classification Search
USPC ..... 315/291, 307, 312, 224, 308
See application file for complete search history.

(56) References Cited

U.S. PATENT DOCUMENTS

| | | | | |
|---|---|---|---|---|
| 6,498,440 | B2 * | 12/2002 | Stam et al. | 315/291 |
| 2008/0074872 | A1 * | 3/2008 | Panotopoulos | 362/231 |
| 2008/0088244 | A1 * | 4/2008 | Morishita | 315/154 |
| 2008/0203936 | A1 * | 8/2008 | Mariyama et al. | 315/246 |
| 2009/0167674 | A1 * | 7/2009 | Katsu | 345/102 |
| 2010/0085512 | A1 * | 4/2010 | Ueda et al. | 349/68 |
| 2010/0102752 | A1 | 4/2010 | Chen et al. | |
| 2010/0148674 | A1 * | 6/2010 | Braun et al. | 315/149 |
| 2010/0171690 | A1 | 7/2010 | Park et al. | |
| 2010/0244740 | A1 * | 9/2010 | Alpert et al. | 315/297 |
| 2010/0308739 | A1 * | 12/2010 | Shteynberg et al. | 315/193 |

FOREIGN PATENT DOCUMENTS

| | | |
|---|---|---|
| CN | 101257750 A | 9/2008 |
| CN | 101658071 A | 2/2010 |

(Continued)

OTHER PUBLICATIONS

European Search Report dated Apr. 18, 2012 filed in European Counterpart Application No. 11193780.1, 6 pages.

(Continued)

*Primary Examiner* — Minh D A
(74) *Attorney, Agent, or Firm* — Patterson & Sheridan LLP

(57) ABSTRACT

An illuminating device includes a plurality of kinds of LEDs that emit light having different color temperatures; a plurality of LED lighting circuits that independently light the LEDs for each color temperature of emitted light; and a control unit that selects a first control changing illuminance of the LEDs as a whole by controlling the lighting of the LEDs and a second control changing the colors of light of the LEDs as a whole by controlling the lighting of the LEDs, and corrects an illuminance difference generated before and after the second control.

23 Claims, 3 Drawing Sheets

(56) References Cited

FOREIGN PATENT DOCUMENTS

| | | | |
|---|---|---|---|
| CN | 101849137 | A | 9/2010 |
| EP | 1924127 | | 5/2008 |
| JP | 2007-012534 | A | 1/2007 |
| JP | 2010-109327 | A | 5/2010 |

OTHER PUBLICATIONS

Japanese Office Action dated Mar. 7, 2014 for Application No. 2010-284905.

JP Office Action dated Dec. 18, 2013 for Application JP2010-284905.

Chinese Office Action dtd Nov. 27, 2013 for Application No. 201110430106.1.

* cited by examiner

ILLUMINATING DEVICE AND ILLUMINATING METHOD

CROSS-REFERENCE TO RELATED APPLICATIONS

This application is based upon and claims the benefit of priority from the prior Japanese Patent Application No. 2010-284905, filed on Dec. 21, 2010, the entire contents of which are incorporated herein by reference.

FIELD

Embodiments described herein generally relate to an illuminating device and an illuminating method.

BACKGROUND

In an illuminating device where a plurality of kinds of LEDs emitting light having different color temperatures is used as a light source, it is possible to make the color of light of LEDs as a whole correspond to a different color temperature by simultaneously lighting up the plurality of kinds of LEDs and mixing the light emitted from the LEDs.

Accordingly, it is possible to tone light through the change of the color of light of LEDs as a whole by changing a light emission ratio for each kind of the color of light emitted from an LED. Further, it is possible to control the light emitted from all LEDs by changing the total amount of light emitted from a plurality of kinds of LEDs having different color temperatures. Furthermore, a user may operate the above-mentioned control by a remote controller in hand.

Meanwhile, for the change of the amount of light emitted from an LED, current flowing in the LED is generally changed. Accordingly, it is possible to change a light emission ratio by changing a ratio between currents of the LEDs for each kind of the color of emitted light. Further, it is possible to change the amount of emitted light by changing the sum of values of the current for each kind of the color of emitted light.

Therefore, in order to perform toning and light control by a plurality of kinds of LEDs that emit light having different color temperatures, LEDs may be lit for each color temperature of emitted light by independent LED lighting circuits and the respective LED lighting circuits may be controlled in a coordinated manner by a control unit such as a microcomputer.

DETAILED DESCRIPTION

The light emission efficiency or the like of a light-emitting diode (LED) tends to vary depending on the color of light emitted from the LED. Accordingly, even though the same power is input to a plurality of kinds of LEDs, the optical outputs of the LEDs are not equal to each other. For this reason, for example, when the power input to the LEDs is made constant and the color of light is toned from one color to the other color, not only light colors but also the amount of light is changed as light emission ratios among the plurality of kinds of LEDs having different color temperatures are changed. As a result, since not only the light colors but also the illuminance is changed, there is a concern that an uncomfortable feeling occurs when a user performs toning.

In view of the above circumstances, an aspect of embodiments provides an illuminating device which includes: a plurality of kinds of LEDs that emit light having different color temperatures; a plurality of LED lighting circuits that independently light the LEDs for each color temperature of emitted light; and a control unit that selects a first control changing illuminance of the LEDs as a whole by controlling the lighting of the LEDs and a second control changing the colors of light of the LEDs as a whole by controlling the lighting of the LEDs, and corrects an illuminance difference generated before and after the second control.

According to an aspect of embodiments, there is provided an illuminating device that can selectively perform toning and light control and does not cause an undesirable change of illuminance when changing, for example, the color of light since correcting an illuminance difference generated by LEDs having different color temperatures when a control unit controls the color of light.

First Embodiment

Figure 1:
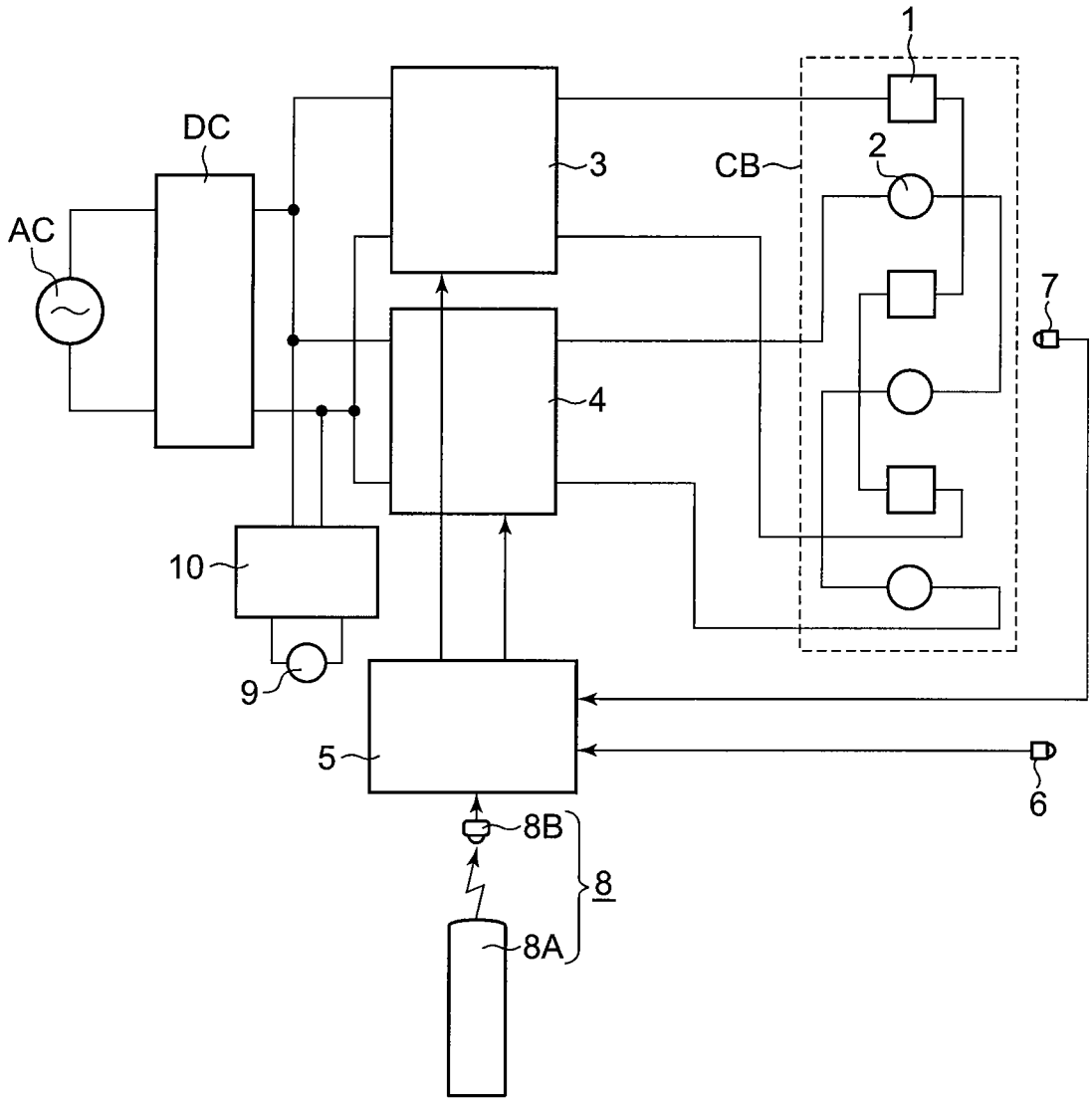
FIG. 1 is a circuit diagram of an illuminating device according to a first embodiment of the invention.

In a first embodiment illustrated in FIG. 1, an illuminating device includes a plurality of kinds of LEDs 1 and 2, a plurality of LED lighting circuits 3 and 4, and a control unit 5, as main components. Further, the illuminating device includes an illuminance sensor 6, a light color sensor 7, a remote controller 8, an auxiliary lamp 9, and an auxiliary lamp lighting circuit 10, as subsidiary components.

The plurality of kinds of LEDs 1 and 2 are formed of a plurality of kinds of LEDs that emit light having different color temperatures. For example, as illustrated in FIG. 1, the illuminating device includes two kinds of LEDs 1 and 2. In this case, the color temperature of an optical output of the LED 1 is relatively high, and the LED 1 corresponds to a W color (daylight color) where, for example, a correlated color temperature is in the range of 6020 to 7040 K. An LED of which the correlated color temperature is 6700 K is used as an example of the LED 1. In contrast, the color temperature of an optical output of the LED 2 is relatively low, and the LED 2 corresponds to an L color (bulb color) where, for example, a correlated color temperature is in the range of 2580 to 2870 K. An LED of which the correlated color temperature is 2800 K is used as an example of the LED 2. Meanwhile, the respective color temperatures may be obtained from a single kind of LED, and may be obtained by additively mixing the optical outputs of a plurality of kinds of LEDs having different colors of emitted light.

Further, since the number of the plurality of kinds of LEDs 1 and 2 is not particularly limited for each kind, one or an arbitrary number of LEDs may be appropriately used for each kind. Furthermore, the number of the LEDs 1 may be equal to the number of the LEDs 2, or may not be equal to the number of the LEDs 2. When a plurality of LEDs 1 and a plurality of LEDs 2 are used, it is preferable that the LEDs 1 and 2 be separately connected to output terminals of LED lighting circuits 3 and 4, which will be described below, in series for each kind of color temperature. Meanwhile, it is allowed that a plurality of LED chips is embedded in the LEDs 1 and 2 so as to be connected in series or parallel.

Furthermore, it is preferable to disperse and mount the plurality of kinds of LEDs 1 and 2 on a substrate CB so that light emitted from the LEDs is easily mixed as a whole. However, since it is also possible to facilitate the mixing of light by using known optical units, such as reflection, refraction, or diffusion, together, the LEDs do not need to be necessarily dispersed.

The plurality of LED lighting circuits 3 and 4 are units that independently light the LEDs 1 and 2 having different color temperatures as understood from the above description for each kind of LEDs having the same color temperature. In the embodiment illustrated in FIG. 1, the plurality of LEDs 1, which are easily discriminated in FIG. 1 by being represented as squares, are connected to one LED lighting circuit 3 in series. Further, likewise, the plurality of LEDs 2, which are represented as circles so as to be easily discriminated in FIG. 1, are connected to the other LED lighting circuit 4 in series. Further, the LEDs 1 and 2 are dispersed and mounted on the substrate CB by being alternately arranged on the substrate CB.

Moreover, the input terminals of the plurality of LED lighting circuits 3 and 4 are connected to a common DC (direct-current) power source DC. Meanwhile, in this embodiment, it is allowed that the DC power source DC is formed of a rectified DC power source of which an input terminal is connected to an AC (alternating-current) power source AC and includes a smoothing capacitor that is connected to an output terminal of the rectified DC power source in parallel although not illustrated in the drawings.

In addition, the plurality of LED lighting circuits 3 and 4 can light the LEDs 1 and 2 in a coordinated manner so as to be capable of continuously controlling and toning light under the control of a control unit 5 to be described below. Meanwhile, a continuous light control includes a light control where brightness is continuously changed and a light control where brightness is changed stepwise, and means that light can be controlled so that brightness is substantially continuously changed. Further, continuous toning includes toning where the color of light is continuously changed and toning where the color of light is changed stepwise, and means that the color of light can be toned so that the color of light is substantially continuously changed. Furthermore, the meaning of making the LEDs 1 and 2 coordinate includes the meaning of a control aspect that changes brightness while maintaining the color of light (color temperature) of the LEDs as a whole substantially constant when preferentially changing brightness and the meaning of a control aspect that changes the color of light (color temperature) while maintaining the brightness of the LEDs as a whole substantially constant when preferentially changing the color of light.

It is only necessary to increase or decrease the output currents of the LED lighting circuits 3 and 4 while maintaining a ratio between the output currents of the LED lighting circuits 3 and 4 constant, in order to preferentially change brightness. Further, it is only necessary to change a ratio between the output currents of the LED lighting circuits 3 and 4 while maintaining the sum of the output currents of the LEDs 1 and 2 constant, in order to preferentially change the color of light.

Furthermore, since the specific circuit types of the plurality of LED lighting circuits 3 and 4 are not particularly limited in this embodiment, DC lighting circuits suitable for LEDs may be appropriately employed. For example, a lighting circuit based on a DC-DC converter is used. When for example, a step-down chopper, preferably, a circuit structure that performs constant current control and/or constant voltage control is employed as the DC-DC converter, there are obtained advantages that the efficiency of a circuit is increased and a circuit is easily controlled.

The control unit 5 controls the lighting of the LEDs 1 and 2 by mainly controlling the LED lighting circuits 3 and 4. While various controls are allowed, the control unit performs at least the following first and second controls and a control for correcting an illuminance difference. Meanwhile, it is preferable that a user can select the first and second controls as desired. In the embodiment illustrated in the drawing, a user can selectively perform the first and second controls by operating a remote controller 8 to be described below.

The first control is a control that preferentially changes the brightness of the plurality of kinds of LEDs 1 and 2 as a whole. If the maximum brightness when the color of mixed light as a whole is a daylight white color is assumed as 100%, in the embodiment illustrated in the drawing, it is possible to change the brightness of a daylight white color stepwise in 20 levels from about 1% to 100% of the total lighting ratio and to change the brightness of a daylight color, where only the LEDs 1 are lit, stepwise in 11 levels from about 1% to about 50% of the total lighting ratio. Further, it is also possible to change the brightness of a bulb color, where only the LEDs 2 are lit, stepwise in 11 levels from about 1% to about 50% of the total lighting ratio. Meanwhile, preferentially changing brightness means changing brightness while the color of light is fixed or substantially fixed.

The second control is a control that preferentially changes the colors of light of the plurality of kinds of LEDs 1 and 2 as a whole. In the embodiment illustrated in the drawing, it is possible to change the color of light stepwise to 21 colors, that is, colors between a daylight color and a bulb color. Meanwhile, preferentially changing the color of light means changing the color of light while brightness is fixed or substantially fixed.

The control for correcting an illuminance difference is a control that substantially eliminates an illuminance difference caused by the difference, or the like, in the light emission efficiency of LEDs having different color temperatures during the control of the color of light. That is, for convenience of the description, it is assumed that the amount of light emitted from the LEDs 1 is larger than the amount of light emitted from the LEDs 2 when constant power is input to each of the LEDs 1 and 2 and this control is not performed. In this case, if the color of light is changed to an L color from a W color in the second control that preferentially changes the color of light, the illuminance of light is reduced. Not only when all of the LEDs, which are lit as in the above-mentioned example, are changed to the LEDs 2 from the LEDs 1 but also when the LEDs to be lit before the second control are formed of the mixture aspect of the LEDs 1 and 2 and a lighting ratio of the LEDs having different color temperatures is changed by the second control so that the color of light is changed, an illuminance difference may be generated. That is, when at least a part of the light emitted from the LEDs is substituted with the light emitted from other LEDs having a different color temperature, an illuminance difference is generated. The embodiment of the invention is to correct the above-mentioned illuminance difference.

The correction of an illuminance difference in the second control of this embodiment is to control light so that an optical output corresponding to a difference between an optical output having a W color and an optical output having an L color is added to an optical output having, for example, an L color. Accordingly, the excess and deficiency of an optical output caused by a difference between the color temperatures of the LEDs 1 and 2 and the like are corrected. In order to perform the above-mentioned correction, for example, the illuminance sensor 6 and the light color sensor 7 may be disposed as described below so as to detect the illuminance and color of light emitted from all of the LEDs and an illuminance difference may be obtained by calculation on the basis of the detected illuminance and color. As correction means different from this, for example, currents flowing in the LEDs 1 and 2 corresponding to an L color may be detected, respectively, so as to obtain a ratio between the currents and table data of an illuminance difference per unit current, which is previously stored, may be read and calculated so as to control light on the basis of the result of the calculation. Meanwhile, even though the LEDs to be lit before the second control are formed of the mixture aspect of the LEDs 1 and 2 and the illuminance difference of the LEDs as a whole is generated due to the change of the lighting ratio of the LEDs caused by the second control, there is a practical significance in the correction of an illuminance difference that is performed by the embodiment of the invention. Further, even though the extent of the correction of an illuminance difference is the extent where not only an illuminance difference is eliminated but also an illuminance difference is reliably reduced before correction, the extent of the correction of an illuminance difference is effective in its way. For this reason, the above-mentioned extent of the correction of an illuminance difference is allowed.

The illuminance sensor 6 is a sensor that detects the illuminance of the surface to be irradiated, and detects illuminance by the combination of the illuminance caused by surrounding brightness and the illuminance caused by the illumination of the illuminating device. Meanwhile, a detection signal of the illuminance sensor is input to the control unit 5 and contributes to the control of illuminance.

The light color sensor 7 is a sensor that detects the color of light of all of the LEDs 1 and 2. A detection signal obtained from the light color sensor 7 is input to the control unit 5 and contributes to the control of the correction of the above-mentioned illuminance difference.

Figure 2:
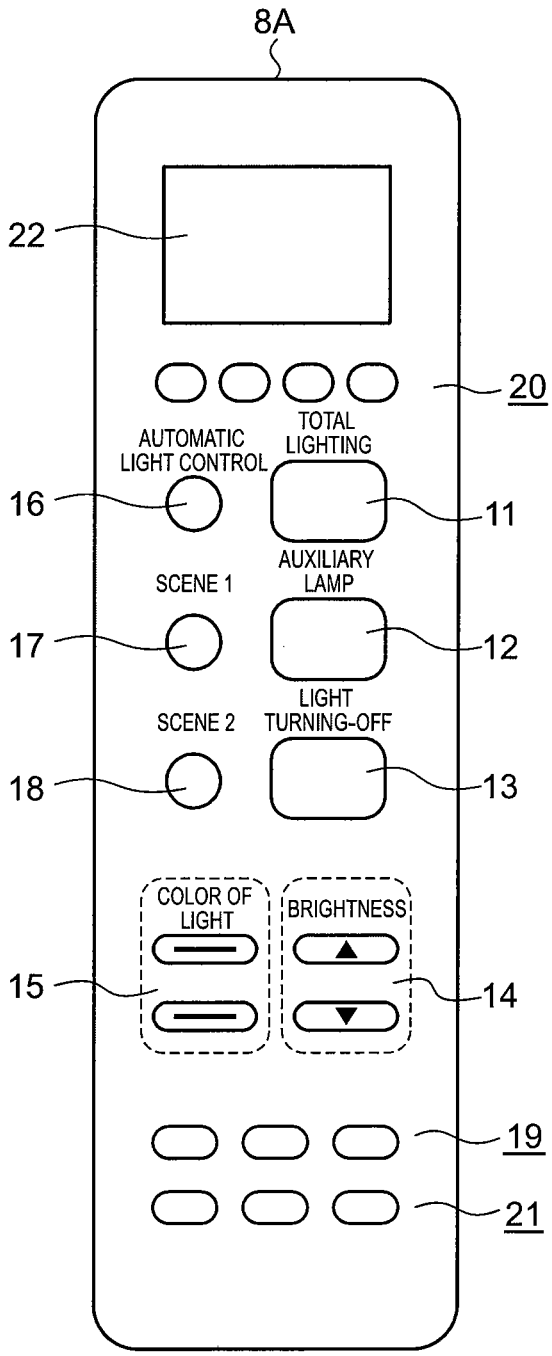
FIG. 2 is a front view of a remote control transmitter according to the first embodiment of the invention.

The remote controller 8 is a unit that is used for a user to operate the illuminating device according to this embodiment in hand. The remote controller 8 includes a transmitter 8A and a receiver 8B. As illustrated in FIG. 2, a total lighting operating part 11, an auxiliary lamp operating part 12, a light turning-off operating part 13, a brightness operating part 14, a light color operating part 15, an automatic light control operating part 16, a scene-1 operating part 17, a scene-2 operating part 18, a timer selection operating part group 19, a timer setting part group 20, another operating part group 21, and a monitor 22 are disposed in transmitter 8A. Main functions of functions of the above-mentioned parts are substantially as follows:

Total lighting operating part 11: The LEDs 1 and 2 are totally lit by the operation of the total lighting operating part, so that the illumination of a daylight white color of 100% can be obtained.

Auxiliary lamp operating part 12: The auxiliary lamp 9 to be described below is lit by the operation of the auxiliary lamp operating part.

Light turning-off operating part 13: All of the LEDs are turned off by the operation of the light turning-off operating part.

Brightness operating part 14: Brightness is increased by the operation of a ▲ part. Brightness is decreased by a ▼ operation.

Light color operating part 15: The color of light is changed toward a daylight color by the operation of an upper button. The color of light is changed toward a bulb color by the operation of a lower button.

Automatic light control operating part 16: Outside light is also detected and brightness is automatically adjusted by the operation of the automatic light control operating part.

A part of the functions of the receiver 8B is incorporated into the control unit 5. Further, the receiver 8B receives a signal transmitted from the transmitter 8A and controls the functions of the control unit 5.

The auxiliary lamp 9 is an auxiliary light source that can be lit when the LEDs 1 and 2 corresponding to a main light source are turned off. The auxiliary lamp 9 may be formed of, for example, an LED having a small optical output.

The auxiliary lamp lighting circuit 10 is a circuit that is used to light the auxiliary lamp 9. The auxiliary lamp lighting circuit 10 is connected to an output terminal of the DC power source DC in parallel with the LED lighting circuits 3 and 4.

Figure 3:
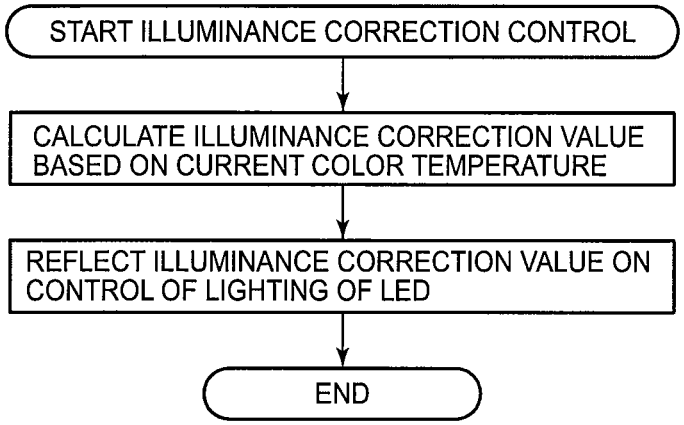
FIG. 3 is a flowchart of illuminance correction control according to the first embodiment of the invention.

Next, illuminance correction control, which corrects an illuminance difference caused by a difference between the colors of light of the LEDs 1 and 2, will be briefly described with reference to FIG. 3. That is, in the illuminance correction control, an illuminance correction value is calculated on the basis of the current color temperature and the obtained illuminance correction value is then reflected on the control of the lighting of the LEDs.

According to this embodiment, even though an illuminance difference is caused by a difference between the colors of light of the LEDs 1 and 2, an illuminance difference is corrected when the color of light is preferentially changed. For this reason, an uncomfortable feeling does not occur.

In an example of this embodiment, when the color of light is changed from a daylight color to a color of light where a bulb color is more intense, the brightness of an LED for a daylight color that is not yet changed is 35 lumen, the value of the current of the LED for the daylight color is 50 ampere, the brightness of an LED for a bulb color that is not yet changed is 30 lumen, and the value of the current of the LED for the bulb color is 50 ampere. In this case, in order to change the color of light to a color of light where brightness is the same and a bulb color is more intense, the brightness of an LED for a daylight color that has been changed is 24 lumen, the value of the current of the LED for the daylight color is 30 ampere, the brightness of an LED for a bulb color that has been changed is 39 lumen, and the value of the current of the LED for the bulb color is 75 ampere. Accordingly, a control where brightness is substantially the same and the color of light is changed can be performed.

Second Embodiment

The second embodiment is adapted so that the speed of the control of light is changed according to the magnitude of the change of illuminance when an illuminance sensor is disposed and the optical outputs of LEDs 1 and 2 are controlled according to surrounding illuminance to maintain desired illuminance. That is, when the change of illuminance is large, illuminance change speed is made to be high (fast). In contrast, when the change of illuminance is small, illuminance change speed is made to be low (slow).

Meanwhile, in this embodiment, the same structure as main parts or substantially the entire structure of the first embodiment may be employed in the structure except for the above-mentioned structure. However, it is also possible to employ a structure different from that of the first embodiment as desired.

In this embodiment, when the change of illuminance is small, a psychological unpleasant feeling does not easily occur if illuminance change is made to be slow. In contrast, when the change of illuminance is large, appropriate illuminance environment is rapidly provided. Accordingly, there is a large merit that followability to the change of illuminance is excellent. Further, in the case of this control, it is found that a psychological unpleasant feeling is relatively reduced and it is hardly uncomfortable.

Figure 4:
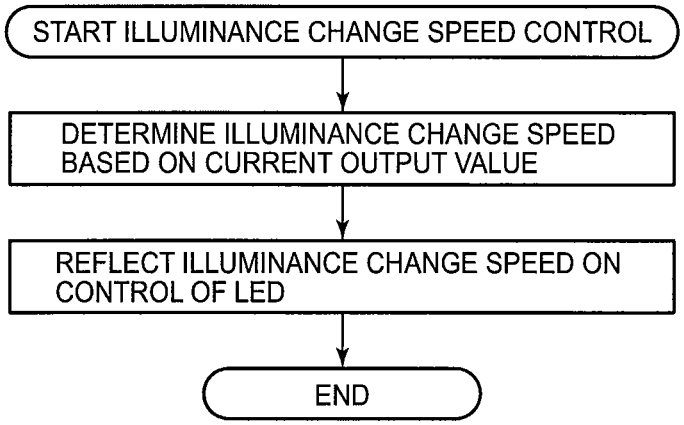
FIG. 4 is a flowchart of illuminance change speed control of an illuminating device according to a second embodiment of the invention.

Next, the second embodiment will be briefly described with reference to FIG. 4. Ina step of "determining illuminance change speed on the basis of the current output value" in illuminance change speed control, illuminance change speed is determined according to the magnitude of the change of illuminance on the basis of the current optical output values of LEDs 1 and 2. Further, in a step of "reflecting the illuminance change speed on the control of LEDs", light is controlled at the determined illuminance change speed so that the change of illuminance is performed. Meanwhile, the illuminance change speed may have two stages or multiple stages.

Furthermore, when illuminance is to be changed, a threshold equal to or higher than a predetermined value is previously provided. If change occurs so as to be equal to or larger than a predetermined value, a control for changing illuminance may be performed. In that case, it is possible to prevent illuminance change speed from varying due to the fluctuation of the setting of very little brightness or the fluctuation of the detection of the variation of brightness, which is performed by the illuminance sensor, caused by the variation of voltage/current.

The above-mentioned embodiment can provide an illuminating device that prevents illuminance from being undesirably changed with the color temperature of the LEDs as a whole when performing toning while using a plurality of kinds of LEDs, which emit light having different color temperatures, as a light source.

While certain embodiments have been described, these embodiments have been presented by way of example only, and are not intended to limit the scope of the inventions. Indeed, the novel methods and systems described herein may be embodied in a variety of the other forms; furthermore, various omissions, substitutions and changes in the form of the methods and systems described herein may be made without departing from the sprit of the inventions. The accompanying claims and their equivalents are intended to cover such forms or modifications as would fall within the scope and spirit of the inventions.

What is claimed is:

1. An illuminating device, comprising:

a plurality of kinds of LEDs that emit light having different color temperatures;

an LED lighting unit that outputs currents to the LEDs to independently light the LEDs that emit light having different color temperatures; and a control unit configured to control the LED lighting unit to change the currents output to the LEDs such that a combined color output of the LEDs is changed while a combined illuminance of the LEDs before and after the change of the currents output to the LEDs is maintained, wherein the plurality of kinds of LEDs include bulb color LEDs and white color LEDs having higher color temperature than that of the bulb color LEDs, and the control unit maintains the combined illuminance of the LEDs before and after the change in the combined color output of the LEDs by changing the current output to the bulb color LEDs without specifically detecting the optical output of the bulb color LEDs, the amount of change in current output corresponding to a change in total optical output of the bulb color LEDs and the white color LEDs.

2. The illuminating device according to claim 1, further comprising:

a remote controller configured to select a brightness operating part performing a first control of the control unit and a light color operating part performing a second control of the control unit.

3. The illumination device of claim 1, wherein the LEDs include a first LED that emits light having a first color temperature and a second LED that emits light having a second color temperature, and a ratio of the output currents to the first and second LEDs determine the combined color output.

4. The illumination device of claim 3, wherein the LED lighting unit includes a first LED lighting circuit configured to generate a first output current to the first LED in accordance with a first control signal from the control unit, and a second LED lighting circuit configured to generate a second output current to the second LED in accordance with a second control signal from the control unit.

5. The illuminating device according to claim 1, wherein the control unit, while the combined illuminance is maintained, controls the current output to the LEDs so that the current output to one of low color temperature LEDs and high color temperature LEDs is higher than the other.

6. The illuminating device according to claim 1, wherein the control unit, while the combined illuminance is maintained, controls the current output to the LEDs so that the current output to low color temperature LEDs is higher than the current output to high color temperature LEDs.

7. The illuminating device according to claim 1, wherein the control unit is configured to detect the combined luminance and the combined color output of light emitted from all of the bulb color LEDs and the white color LEDs, and determine the total optical output of the bulb color LEDs and the white color LEDs therefrom.

8. An illuminating device, comprising:

a first LED that emits light with a first color of light;

a second LED that emits light with a second color of light different from the first color of light;

a first lighting circuit that controls the lighting of the first LED;

a second lighting circuit that controls the lighting of the second LED;

a control unit that comprises:

an illuminance control unit configured to control the first lighting circuit and the second lighting circuit to output currents to the LEDs to change a combined illuminance of the LEDs;

a light color control unit configured to control the first lighting circuit and the second lighting circuit to output currents to the LEDs to change the combined color output of the LEDs; and a correction unit configured to control the first lighting circuit and the second lighting circuit to output currents to the LEDs such that the combined illuminance of the LEDs is maintained before and after the change in the combined color output of the LEDs by changing the current output to the first LED without specifically detecting the optical output of the first LED, the amount of change in current output corresponding to a change in total optical output of the first LED and the second LED.

9. The illuminating device according to claim 8, wherein when illuminance is changed, output currents of the first LED lighting circuit and the second LED lighting circuit are increased or decreased together.

10. The illuminating device according to claim 8, wherein when the color of light is changed, a ratio between output currents of the first LED lighting circuit and the second LED lighting circuit is changed.

11. The illuminating device according to claim 8, wherein the amount of light emitted from the first LED is larger than the amount of light emitted from the second LED when constant power is input to each of the first LED lighting circuit and the second LED lighting circuit.

12. The illuminating device according to claim 11, wherein the first LED emits light with a daylight color and the second LED emits light with a bulb color.

13. The illuminating device according to claim 8, further comprising:

an illuminance sensor that measures illuminance of the first LED and the second LED as a whole; and a light color sensor that measures the color of light of the first LED and the second LED as a whole, wherein the illuminance and color of light of the first LED and the second LED are detected by the illuminance sensor and the light color sensor, and are corrected based on detection results.

14. The illuminating device according to claim 13, wherein the illuminance sensor detects the illuminance of a surface to be irradiated, and detects illuminance by the combination of illuminance caused by surrounding brightness and illuminance caused by the illumination of the illuminating device.

15. The illuminating device according to claim 8, wherein currents flowing in the first LED and the second LED are detected, respectively, so as to obtain a ratio between the currents and data of an illuminance difference per unit current, are read and calculated so as to perform a correction based on the result of the calculation.

16. The illuminating device according to claim 8, wherein the correction unit calculates an illuminance correction value based on a current color temperature and controls the first LED lighting circuit and the second LED lighting circuit by using the obtained illuminance correction value.

17. The illuminating device according to claim 8, further comprising:

an illuminance sensor, wherein when optical outputs of the first LED and the second LED are controlled according to surrounding illuminance measured by the illuminance sensor, and wherein a light control speed is changed according to the magnitude of the change of illuminance.

18. The illuminating device according to claim 17, wherein an illuminance change speed is high when the change of illuminance is large, and the illuminance change speed is low when the change of illuminance is small.

19. An illuminating method that includes a first LED emitting light having a first color of light and a second LED emitting light having a second color of light different from the first color of light, the method comprising:

controlling a combined illuminance of the first LED and the second LED;

controlling a combined color output of the first LED and the second LED; and correcting the combined illuminance by an illuminance control unit when the combined color output is changed, such that the combined illuminance of the LEDs is maintained before and after the change in the combined color output by changing the current output to the first LED without specifically detecting the optical output of the first LED, the amount of change in current output corresponding to a change in total optical output of the first LED and the second LED.

20. The illuminating method according to claim 19, further comprising:

adjusting a first current supplied to the first LED and a second current supplied to the second LED when the combined illuminance is changed.

21. The illuminating method according to claim 19, further comprising:

changing a ratio between a first current supplied to the first LED and a second current supplied to the second LED when the combined color output is changed.

22. The illuminating method according to claim 19, further comprising:

detecting currents flowing in the first LED and the second LED, respectively, so as to obtain a ratio between the currents; and reading and calculating data of an illuminance difference per unit current value so as to perform correction based on the result of the calculation.

23. The illuminating method according to claim 19, further comprising:

making an illuminance change speed be high when the change of illuminance is large; and making an illuminance change speed be low when the change of illuminance is small.

* * * * *